United States Patent [19]

Garcia

[11] Patent Number: 4,921,110

[45] Date of Patent: May 1, 1990

[54] DEVICE FOR EXTENDING AND RETRACTING A WARDROBE FROM AND INTO A FALSE CEILING

[76] Inventor: Michel Garcia, "Rabajou Bellevue"-Saint Marcel Saint Sylvestre, 47140 Pennes D'Agenais, France

[21] Appl. No.: 225,468

[22] Filed: Jul. 28, 1988

[30] Foreign Application Priority Data

Jul. 29, 1987 [FR] France ..... 87 10858

[51] Int. Cl.[5] ..... A47F 5/00

[52] U.S. Cl. ..... 211/1.3; 211/170; 312/328

[58] Field of Search ..... 211/1.3, 86, 170; 312/327, 328, 248

[56] References Cited

U.S. PATENT DOCUMENTS 4,424,907 1/1984 Robb ..... 211/170 X
4,485,928 12/1984 Staashelm ..... 211/1.3 X
4,699,437 10/1987 Geneveaux ..... 312/248
4,733,925 3/1988 Duran et al. ..... 312/248

*Primary Examiner*—Robert W. Gibson, Jr.
*Attorney, Agent, or Firm*—Robert J. Koch

[57] ABSTRACT

The invention provides a device for extending a wardrobe from and retracting it back into a false ceiling. This wardrobe mechanism is intended to be integrated into a suspended storage system comprised of uniform ceiling panels. The wardrobe of the invention pivots between a horizontal closed position and a vertical open position. A suitably positioned weight compensation caliper arm assures one can easily extend and retract the wardrobe with a minimum of effort. A set of pinions transfer the movement of the wardrobe through an endless chain to a clothes hanger device. Thus, pulling the wardrobe down from the ceiling positions the clothes close to the ground within easy reach, pushing the wardrobe closed repositions and stacks the clothes flat.

10 Claims, 4 Drawing Sheets

DEVICE FOR EXTENDING AND RETRACTING A WARDROBE FROM AND INTO A FALSE CEILING

BACKGROUND TECHNOLOGY

1. Field of the Invention

A device for extending and retracting a wardrobe from and into a false ceiling.

The present invention relates to a device for extending a wardrobe from a false ceiling structure and retracting it therein.

2. Description of the Related Technology

More precisely, the invention relates to an extension and retraction mechanism for integration in a suspended storage system of the type described in document EP-A-O No. 182.731.

This document relates to a suspended storage device with juxtaposed pivoting compartments characterized in that it is formed from a plurality of storage compartments each disposed on the upper face of a flat rectangular or square panel mounted for pivoting about an axis parallel to one of the longitudinal sides and in the vicinity thereof, on two elements mounted fixedly to both lateral ends of the panel, means being provided for locking the panels in the horizontal position and limiting downward opening thereof substantially to the vertical position, the panels being aligned side by side in one or two directions while being parallel to each other and at a very small distance without any fixed structural element interposed therebetween in the direction of alignment orthogonal to the pivot axes.

Such a device forms a multiple storage structure which can be formed at will for it is capable of extending in two orthogonal directions so as to form, because of the single lower face of the panels juxtaposed in a checker pattern, a practically continuous surface, in the raised position of the storage compartments, without projection or recess, itself forming a false ceiling both aesthetic and functional.

SUMMARY OF THE INVENTION

An object of the invention is to integrate in such a structure a mechanism for extending a wardrobe making possible the integral retraction of this wardrobe inside said false ceiling.

For this, the invention provides a device for extending a wardrobe from and retracting it into a false ceiling, for integration in a suspended storage system comprising panels, more particularly rectangular flat and juxtaposed, forming a false ceiling and mounted for pivoting between two stable positions, one a horizontal closed position defining said false ceiling and the other a vertical open position, characterized in that it is formed of a toothed sector mounted fixedly laterally on one of the panels and centered on the pivot axis of this panel, a pair of pinions fixed on the same shaft parallel to said pivot axis and carried by a support fixed to the panel laterally thereon and in the vicinity of the pivot axis, one of the pinions being engaged with said toothed sector and the other pinion driving an endless chain passing over a third pinion carried by said panel, said chain being parallel to the panel and, by one of its sides, driving an arm parallel to said pivot axis and carrying a clothes hanger device, means being provided for guiding said arm during its translational movement parallel to the panel.

Such a device is able to occupy two stable end positions, one in which the panel is raised and flush with the other panels of the false ceiling structure, the wardrobe being completely retracted and the clothes being situated horizontally while resting stacked flat on the upper face of said panel and the other in which the panel is lowered and vertical, the clothes hanger system being in a low very readily accessible position, the clothes being suspended vertically.

The panel has of course sufficient dimensions so that the whole surface of the clothes may be stored flat and, in the case where it is not desired to disturb the harmony of the panels of the storage device in which the wardrobe of the invention is integrated, the wardrobe panel may be formed from several juxtaposed panels of said storage device, these panels being interlocked so as to form only one and of course only comprising a single locking and opening angle limiting system.

The panel of the wardrobe of the invention is furthermore provided, like all the individual panels of said storage device, with a weight compensation means such as gas driven calliper arms as described in the above mentioned document.

BRIEF DESCRIPTION OF THE DRAWINGS

Other features and advantages will be clear from the following description of one embodiment of the invention, given solely by way of example with reference to the accompanying drawings in which.

DETAILED DESCRIPTION OF THE DRAWINGS

Figure 1:
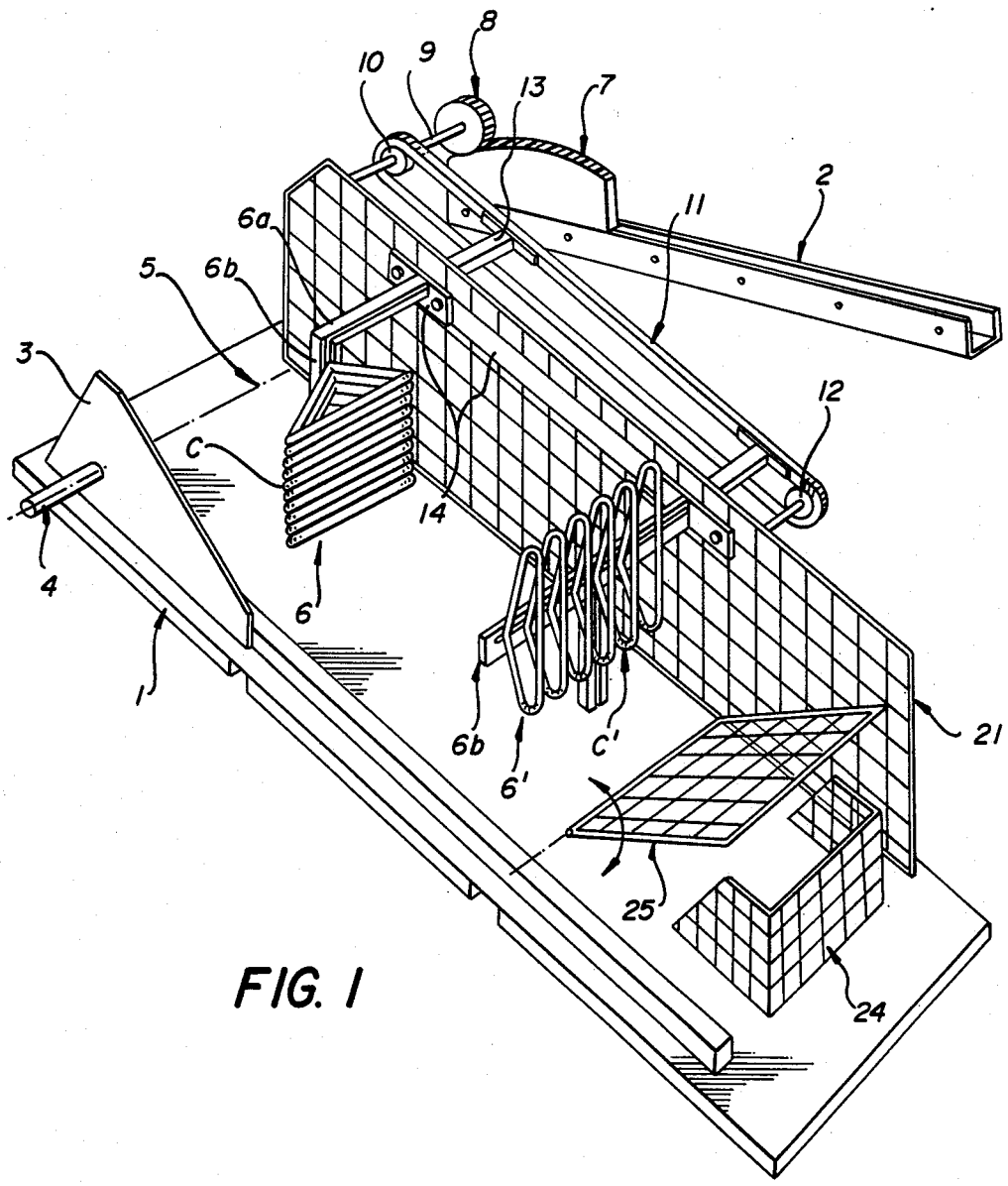
FIG. 1 is a schematic perspective view illustrating the principle of the device of the invention.

In FIG. 1 the principle of the device of the invention has been illustrated very schematically. This device comprises a panel 1 formed of three adjacent panels interlocked together so as to form only one of appropriate dimensions. These three panels are in particular panels identical to those of the false ceiling structure in which the wardrobe is to be integrated. The advantage of constructing panel 1 by interlocking said three panels is aesthetic. Thus, the visible face of the false ceiling is given continuity, the position of the wardrobe not being visible since said three panels, once raised, are strictly identical to the other surrounding panels assigned to other storage purposes and having dimensions appreciably less than those required for retracting a wardrobe.

Said panel 1 is suspended and pivotally mounted as for the device described in the above mentioned document. Briefly, this device comprises two horizotal parallel channel irons 2 (only one being shown in FIG. 1), mounted fixedly in the immediate vicinity of the two longitudinal edges of panel 1 in the raised horizontal postion thereof.

Panel 1 comprises, close to one of its ends, two brackets 3 fixed to the internal face close to the longitudinal edges, each carrying a pivot pin 4 defining the horizontal pivot axis 5 of the panel with respect to channel irons 2.

Figure 3:
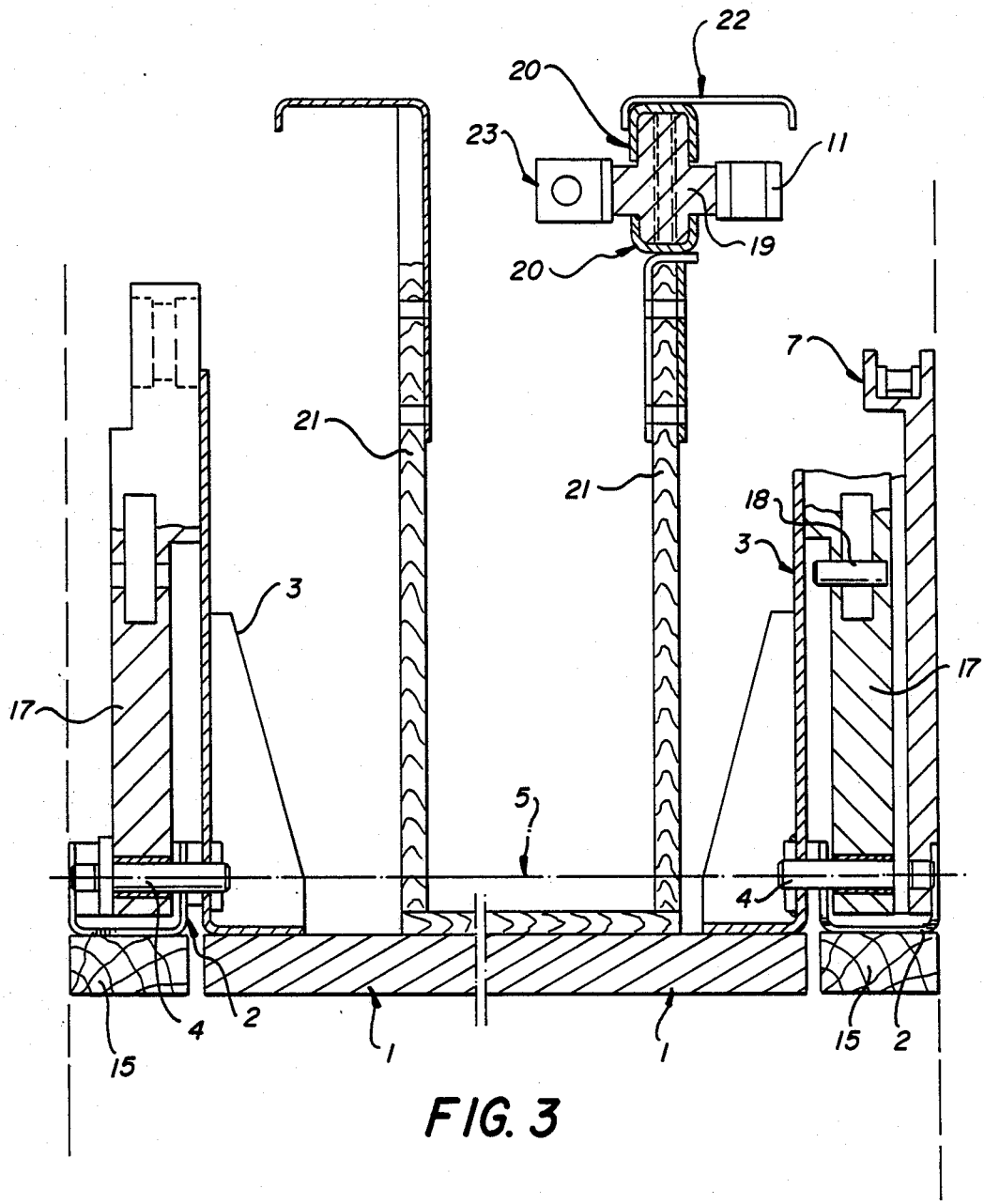
FIG. 3 is a sectional view through line III—III of the device of FIG. 2.

This structure is shown more clearly in FIG. 3.

On one side of panel 1 is disposed the system of the present invention for extending a wardrobe (symbolized by a clothes hanger device 6). This system comprises a toothed sector 7 fixed to one of the channel irons 2, the teeth being located on an arc of a circle centered on the pivot axis 5 of panel 1.

A first pinion 8 is engaged with the toothed sector 7 and is able to move thereover. Pinion 8 is keyed to a shaft 9 parallel to axis 5 and carrying a second pinion 10 also keyed to the shaft.

Shaft 9 is firmly secured to panel 1. Pinion 10 drives an endless chain 11 passing over a third pinion 12 also fixed to panel 1, the sides of chain 11 being parallel to the panel.

One of said sides drives an arm 13 parallel to axis 5 and guided in its translational movements by means 14 fixed to panel 1.

At its end arm 13 has said clothes hanger device 6 which is adapted so as to position the clothes hangers parallel to the panel in the high position (position 6) of the device, namely the position for storing the clothes flat against the internal face of panel 1 in the raised retracted position of the wardrobe. In the extended low position (position 6') of the clothes hanger device, the clothes hangers may be placed orthogonal to the plane of the panel so as to facilitate the placing and removal of clothes in the lowered vertical position of panel 1.

Said low position 6' places the clothes hanger device at the right height for handling the clothes hangers.

One embodiment of the device shown schematically in FIG. 1 will now be described in greater detail with reference to FIGS. 2 to 4.

Figure 2:
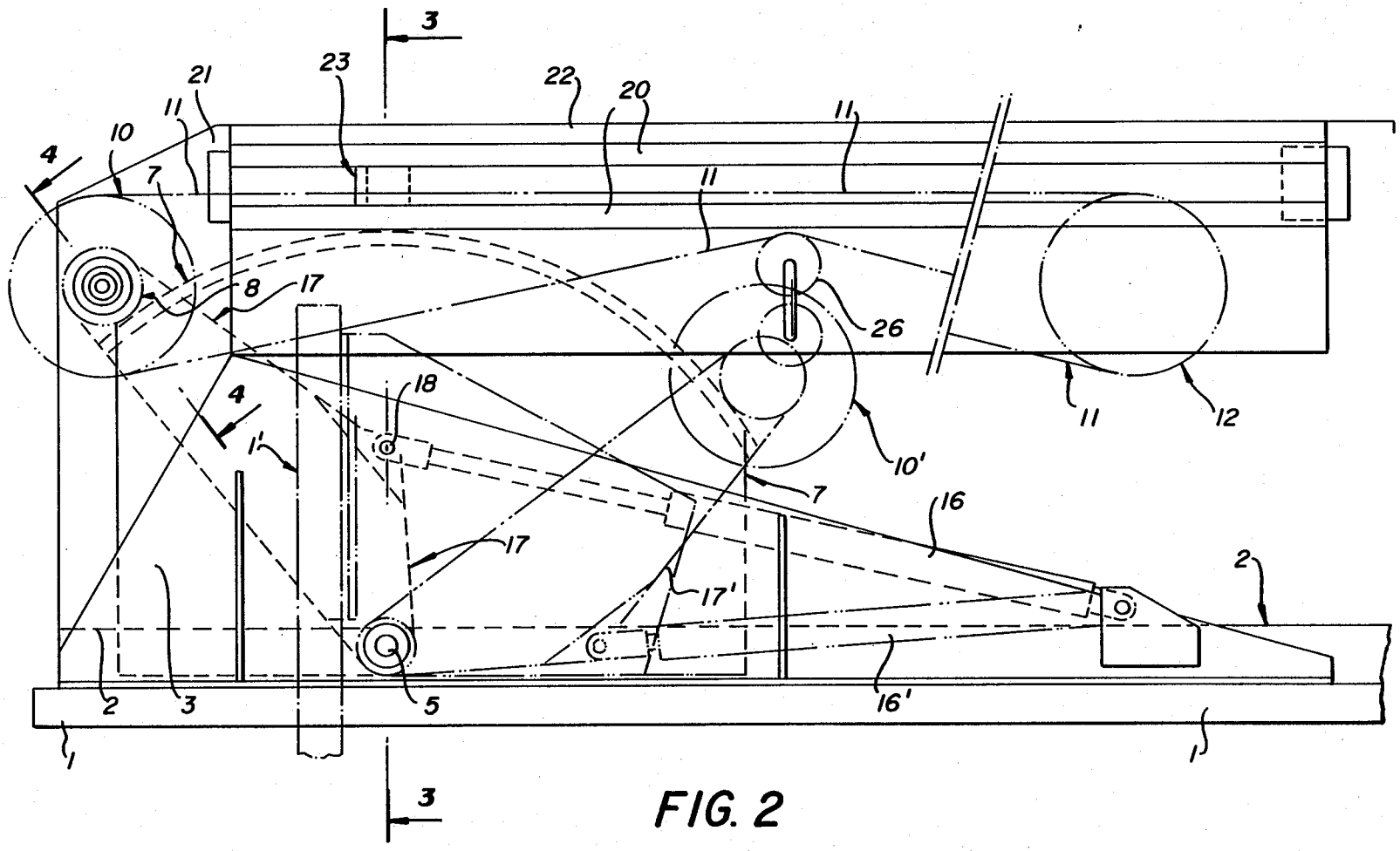
FIG. 2 is a partial side elevational view of the device of FIG. 1.
Figure 4:
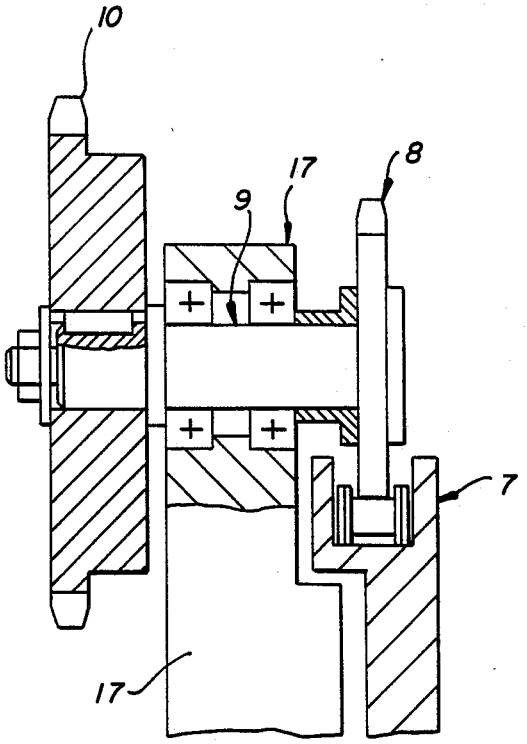
FIG. 4 is a sectional view through line IV—IV of the device of FIG. 2.

In FIGS. 2 to 4, the elements similar to those of FIG. 1 bear the same reference numbers.

FIG. 3 is a section through line III—III of the device passing through the pivot axis 5 of panel 1.

In FIG. 3 the two fixed horizontal channel sections 2 have been shown surrounding the panel 1 (in the raised horizontal position).

Channel irons 2 are fixed to the upper face of two wooden battens 15 providing aesthetic continuity with panel 1.

At 16 in FIG. 2 a gas calliper arm device has been shown for compensating the weight of the pivoting assembly in accordance with the device described in document EP-A-O No. 182 731. The calliper arm device 16 is anchored both to channel iron 2 and, by the end of its rod, to a support 17 fixed to the external face of bracket 3 (FIG. 3), this support 17 extending in line with channel iron 2. A similar device is provided in line with the other channel iron 2.

At 18 in FIGS. 2 and 3 the pivot axis has been shown of the rod of the calliper arm device 16 on support 17.

Shaft 9, carrying fixed to both its ends pinions 8 and 10 (FIG. 4) is journalled in its central part in ball bearings carried by said support 17.

Chain 11 is engaged by its upper side with a drive piece 19 (corresponding to the arm 13 of FIG. 1) which slides in a guide device 20 formed by two facing gutters fixed parallel to the longitudinal edge of panel 1 at the upper part of a lateral dividing wall 21 itself fixed to said panel 1. The upper gutter 20 as well as the upper side of chain 11 are hidden by a cover 22. Dividing wall 21 also carries a pin on which pinion 12 is journalled.

Symmetrically to dividing wall 21 another dividing wall 21 is provided on panel 1 (FIG. 3) for possibly mounting mechanism 7–12 on the other side of the panel.

Gutters 20 run over practically the whole length of the upper side of chain 11.

The end of the piece or slide 19 projecting from the dividing wall 21, on the inside, is provided with a lug 23 for fixing the clothes hanger device 6. This latter may have different forms. Preferably it is mounted for pivoting and is retractable for questions of space, ease of handling and also to allow clothes to be stacked flat on each other against the upper face of the panel in the retracted position of the wardrobe into the false ceiling (FIG. 3).

Such a device 6 may, as shown schematically in FIG. 1, be formed of a fixed part 6*a* parallel to axis 5 and a part 6*b* pivoting on part 6*a* so as to assume either a position perpendicular to part 6*a* or a position in the extension thereof.

In the first position the clothes hangers (C) may be placed parallel to panel 1 while being grouped together in part 6*b* : this is the horizontal storage position of the clothes, the arm 13 (or slide 19) being in its so-called high position, the closest to the pivot axis 5 of panel 1.

In the second position, the clothes hangers C' are perpendicular to panel 1 and may be opened out over the two parts 6*a*, 6*b*.

Panel 1 may, at its lower part, in the extended position of the wardrobe, have a storage compartment 24, for example for shoes, with which is associated a flap 25 which can be folded back and forms an inclined plane when panel 1 is raised, over which the stack of clothes may slide and rest. The length of panel 1 is sufficient so that in the top position of the clothes hangers, the lower end of the clothes is at the level of the inclined plane 25.

At 26 in FIG. 2 a roller has been shown for tensioning chain 11, this roller being of course adjustable in position. In this same FIG. 2, at 10', 16', 17' the respective positions of members 10, 16, 17 have been shown corresponding to lowering of the panel to the vertical position 1'.

The panel can be operated effortlessly, because of the weight compensation devices 16, by gripping the side flange opposite the pivot axis 5.

The panel 1 may of course be formed of a single plate or a number of elementary panels interlocked together greater or smaller than three.

It should be noted that in the embodiment shown in FIG. 4, pinion 10 is appreciably greater than pinion 8 so as to have a step down effect, namely a stroke of slide 19 greater than that of pinion 8, for reducing the toothed sector 7 as much as possible.

Finally, the invention is obviously not limited to the embodiments shown and described above but covers on the contrary all variants thereof particularly in so far as the structure and arrangement of the clothes hanger device 6 are concerned and its guide and drive means parallel to the plane of panel 1, from rotation of pinion 8 on the toothed sector 7.

I claim:

1. A device for extending a wardrobe from and retracting it into a false ceiling which comprises:

a panel, forming a false ceiling and pivoting about an axis between a horizontal closed position and a vertical open position;

a toothed sector fixed laterally and centered on said axis of said panel, a first pinion and a second pinion fixed on a shaft mounted parallel to said axis, said shaft carried by a support fixed laterally to said panel in the vicinity of said axis, said first pinion engaging said toothed sector, said second pinion driving an endless chain passing over a third pinion, said chain being parallel to said panel and driving an arm, said arm carrying a clothes hanger device so that raising and lowering said panel is translated through said chain to raise and lower said arm.

2. A device according to claim 1, further characterized in that said arm is driven by said chain and guided in a double gutter, said double gutter is mounted to a lateral dividing wall fixed to said panel.

3. A device according to claim 1 in which said clothes hanger device is pivotably mounted so as to present the clothes hanger either parallel or perpendicular to said panel (1).

4. A device according to claim 1, in which said first pinion engaged with said toothed sector has a diameter appreciably less than that of said second pinion driving said chain.

5. A device according to claim 1 in which said first pinion and said second pinion are fixed to opposite ends of a centrally journalled shaft positioned on said support, and further comprising a weight compensation device connected to said support.

6. A device according to claim 2 in which said clothes hanger device is pivotably mounted so as to present the clothes hangers either parallel or perpendicular to said panel.

7. A device according to claim 3 in which said first pinion engaged with said toothed sector has a diameter appreciably less than that of said second pinion driving said chain.

8. A device according to claim 2 in which said first pinion and said second pinion are fixed to opposite ends of a centrally journalled shaft positioned on said support, and further comprising a weight compensation device connected to said support.

9. A device according to claim 3 in which said first pinion and said second pinion are fixed to opposite ends of a centrally journalled shaft positioned on said support, and further comprising a weight compensation device connected to said support.

10. A device according to claim 4 in which said first pinion and said second pinion are fixed to opposite ends of a centrally journalled shaft positioned on said support, and further comprising a weight compensation device connected to said support.

* * * * *